United States Patent [19]

Blyakharov et al.

[11] 4,300,288

[45] Nov. 17, 1981

[54] CAN OPENER

[76] Inventors: Ayzik Blyakharov, 31-41 23 St., Astoria, N.Y. 11106; Joseph S. Kagantsev, 35-33 83 St., Jackson Heights, N.Y. 11372

[21] Appl. No.: 217,250

[22] Filed: Dec. 17, 1980

[51] Int. Cl.[3] ..... B27B 7/30

[52] U.S. Cl. ..... 30/409; 30/429

[58] Field of Search ..... 30/409, 429

[56] References Cited

U.S. PATENT DOCUMENTS

| | | | |
|---|---|---|---|
| 1,082,800 | 12/1913 | Darque | 30/429 |
| 1,364,016 | 12/1920 | Worthington | 30/409 |
| 1,507,093 | 9/1924 | Schioniger | 30/429 |
| 1,669,311 | 5/1928 | Strengberg | 30/429 |
| 2,412,946 | 12/1946 | Bloomfield | 30/429 |
| 2,413,528 | 12/1946 | Speaker | 30/429 |
| 2,733,505 | 2/1956 | Kinnington | 30/429 |

*Primary Examiner*—Jimmy C. Peters
*Attorney, Agent, or Firm*—Ilya Zborovsky

[57] ABSTRACT

A can opener has a first flat member provided with two open slots spaced from one another in direction of elongation, and a second member having two oppositely facing cutting edges so that the can opener can be used by both left-handed persons and right-handed persons. The members are separate and connected with one another by connecting unit which allows their movement between unfolded operative position and folded inoperative position. The connecting unit is arranged between the cutting edges. A unit preventing an unintentional movement of the members from the inoperative position is also provided.

7 Claims, 7 Drawing Figures

CAN OPENER

BACKGROUND OF THE INVENTION

The present invention relates to a can opener and the like.

Can openers of various constructions are known in the art and widely utilized. Generally, the same can opener is inconvenient to be utilized by both a left-handed person and a right-handed person. Applicants have recognized this problem and proposed a can opener in which two cutting edges faced away from one another is provided on one flat member, and the latter is connected with the other flat member having supporting openings to support on a can and serving as a handle. This construction is disclosed in the previous application of the same inventors and proved to be satisfactory for the above mentioned purposes. In this construction, however, the members were of one piece with one another and they extended normal to each other so that injury is not precluded by the normally extending cutting edges. The members could not be folded toward one another so as to extend substantially in the same plane. This also makes inconvenient storage and tranportation of the can openers.

SUMMARY OF THE INVENTION

Accordingly, it is an object of the present invention to provide a can opener which avoids the disadvantages of the prior art.

More particularly, it is an object of the present invention to provide such a can opener which has two members extending transverse to one another in an operative position and being able to be folded so as to extend parallel to one another in an inoperative position.

In keeping with these objects and with others which will become apparent hereinafter, one feature of the present invention resides, briefly stated, in that a can opener has a first member with two supporting slots and a second member with cutting edges for left-handed and right-handed user, wherein the members are foldable from the operative position to the inoperative position, they are separate members, and connected with one another by connecting means allowing such folding. The very important distinctive feature of the invention is that, despite the provision of two cutting edges, there is only one connecting means for the same, which connecting means is located in the region between the cutting edges, as considered in direction of elongation of both members. Such a construction not only allows the above mentioned folding, but also is very simple and easy to manufacture. Moreover, it avoids obvious duplication of the connecting means.

The novel features which are considered as distinctive for the present invention are set forth in particular in the appended claims. The invention, however, will be understood itself from the description which is presented hereinbelow, and the drawings which accompany this description.

DESCRIPTION OF PREFERRED EMBODIMENT

Figure 1:
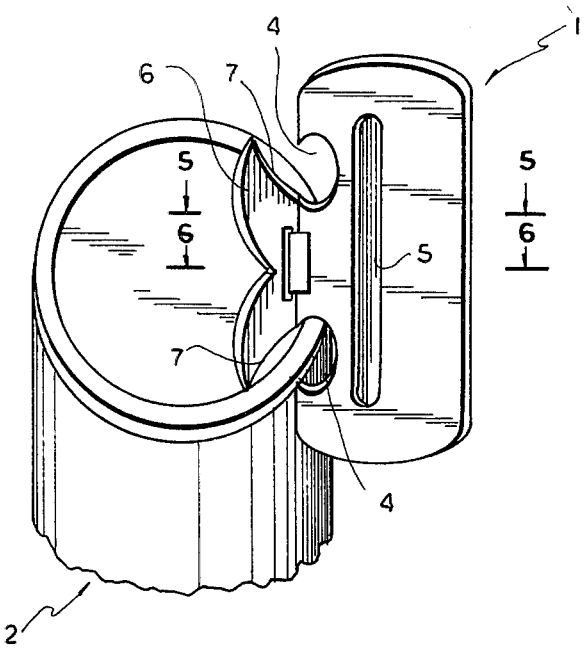
FIG. 1 is a view showing a can opener in accordance with the present invention, in a perspective.

A can opener in accordance with the present invention has a first member which is identified by reference numeral 3 and a second member which is identified by reference numeral 6. The members 3 and 6 are separate members and connected with one another as will be explained hereinbelow.

The member 3 is elongated in a first direction and has two open slots 4 which are substantially circular and spaced from one another in the direction of elongation of the member 3. Each slot 4 may be utilized for supporting of the member 3 on a bead of a can in a respective position of the member 3. The member 3 is also provided with a reinforcing rib 5 produced, for example, by stamping and extending in the direction of elongation so that it at least partially overlaps the regions in which the open slots 4 are located. Thereby the rib 5 provides for reinforcement not only in the central region of the member 3 but also in the regions of the slots 4, which are susceptible to bending forces.

The second member 6 has two cutting edges which are identified by reference numerals 7 and extends from one lateral side of the member 6 to the other lateral side of the same. The cutting edges 7 are located in the regions adjacent to the open slots 4 of the member 3. Each cutting edge 7 is suitable for a person which uses his left hand or his right hand respectively. A person which acts by his respective hand, puts the member 3 so that the respective slot 4 surrounds the bead of the can and support the member 3 on the same, and then applies force to the member 3 in condition when a respective one of the cutting edges 7 cuts through the can cover. The user inclines the cutting edge into the can and then inclines the same back from the can. By successively alternating inward and outward movements the can cover is cut over a required perimeter.

The above described operation is performed when the members 3 and 6 extend transverse to one another. After the utilization it is advisable to fold the can opener so that the members 3 and 6 extend parallel to one another. This is performed by connecting means which is formed as follows. The member 6 has a through opening 9 which defines together with the lateral side of the member 6, a web 10. It is also possible (but not necessary) to provide an open recess 11 at the above mentioned lateral side. On the other hand the member 3 has a loop-shaped projection 8 which, in assembled condition, surrounds the web 10. More particularly, it first extends through the open recess 11 and then engages into the through opening 10. Thereby the members 3 and 6 can turn relative to one another between the operative position shown in FIG. 1 and the inoperative position shown in FIG. 2.

Figure 2:
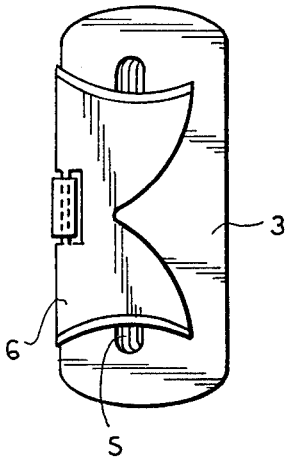
FIG. 2 is a view showing the can opener in accordance with the invention, in folded condition.
Figure 3:
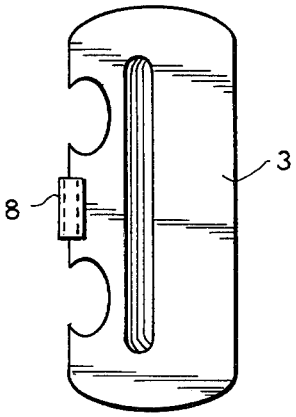
FIG. 3 is a side view showing a first separate member of the invention can opener, the portion provided with supporting slots and a loop-shaped projection.
Figure 4:
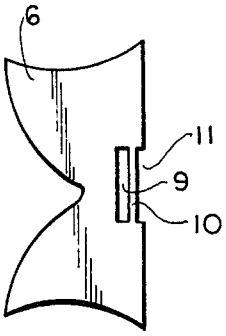
FIG. 4 is a side view showing a second separate member of the inventive can opener, the second member provided with cutting edges and a receiving opening for receiving the loop-shaped projection of the first member.

In accordance with another important feature of the present invention, the dimensions of the members 3 and 6 are such that in the inoperative position shown in FIG. 2 the second member 6 is located inside the outer contour of the first member 3, completely. This is very convenient for storage, transportation and avoidance of injuries. Moreover, the open slots 4 of the member 3 and the cutting edges 7 of the member 6 have such shapes that at least a portion of each of the cutting edges 7 coincides with a portion of the open slot 4. This also supplements to the protection against injuries by the cutting edges.

Figure 5:
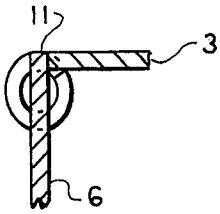
FIG. 5 is a view showing a section taken along the line 5—5 in FIG. 1 and showing a connecting unit of the inventive can opener.
Figure 6:
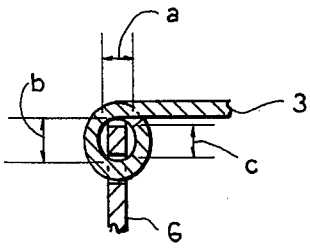
FIG. 6 is a view which also shows the connecting unit of the invention can opener, but represents a section taken along the line 6—6 in FIG. 1, wherein the can opener in in an operative position.

During cutting, the member 6 is held in its normal position to the member 3 because of the abutment against the can and also because of the provision of stop means. As can be seen in FIG. 5, the member 3 and 6 and the connecting means are so arranged that in the operative position the lateral surface of the member 6 abuts against and end face 12 of the member 3 so as to form the above mentioned stop means.

As for the mutually parallel position of the members 3 and 6 after the operation, means is also provided for retaining the members 3 and 6 in this position. The inner opening of the loop-shaped projection 8 is non-round. The dimension of the inner opening in direction transverse to the plane of the member 3 which is identified by reference letter "b" is greater than the respective dimension of the web 10 which is identified by reference letter "c".

Figure 7:
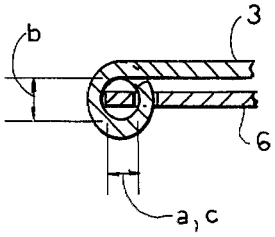
FIG. 7 is a view substantially corresponding to that of FIG. 6 but showing the can opener in an inoperative position.

However, the dimension of opening in direction parallel to the plane of the member 3, which is identified by reference letter "a" is smaller or at most equal to the dimension "c" of the web 10. Thereby, when the member 6 is normal to the member 3 in the operative position, the members can freely move toward one another to the inoperative position because of the gap between "b" and "c". When, however, the members assume their inoperative position shown in FIG. 7, the web 10 is clamped in the inner opening of the loop-shaped projection 8 because of the relation between "a" and "c" causing friction between the web 10 and the wall surrounding the inner opening. This prevents unintentional movement of the members 3 and 6 from their inoperative position to the operative position.

The invention is not intended to be limited to the details shown since various modifications and structural changes are possible without departing in any way from the spirit of the present invention. Thereby all such modifications and structural changes fall within the scope of the invention.

What is claimed as desired to be protected by Letters Patent is set forth in the appended claims:

1. A can opener, comprising a first substantially flat member extending in a first direction and having two lateral sides spaced from one another in a second direction transverse to said first direction, said first member having two slots arranged and open at one of said lateral sides so that each slot can surround a bead of a can;

a second substantially flat member also extending in said first direction and also having two lateral sides spaced from one another in transverse direction, said second member having two cutting edges each arranged in the region of a respective one of said slots and extending between the lateral sides of said second member, said cutting edges facing away from one another so that they can be used alternately by a left-handed person and a right-handed person, said members being separate members and connected with one another along one of the lateral sides of each of said members movable between an operative position in which said members are unfolded and extend transversely to one another, and an inoperative position in which said members are folded and extend substantially parallel to one another, said members being dimensioned so that said second member has an outer contour which is located within the outer contour of said first member completely, when said members are in said inoperative position; and means for movably connecting said members with one another and arranged between said cutting edges, as considered in said first direction.

2. A can opener as defined in claim 1, wherein said connecting means includes an open recess which is open at the other lateral side of said second member and a through opening spaced from said open recess in the transverse direction so as to form a web therebetween, said connecting means further having a loop-shaped projection formed on the one lateral side of the first member between said slots and extending through said open recess of said second member whereupon said loop-shaped projection engages in said through opening of the same, said open recess and said through opening is located between said cutting edges of said second member, as considered in said first direction.

3. A can opener as defined in claim 1, wherein said cutting edges of said second member and said open slots of said first member are arranged so that in said inoperative position at least a portion of a contour of one of said cutting edges coincides with at least a portion of a contour of a respective one of said slots.

4. A can opener as defined in claim 1; and further comprising means for reinforcing said first member, said reinforcing means includes a rib which is raised from said flat member transversely to its outer surface and extends in said first direction over such a distance that it at least partially extends into the regions wherein said open slots are formed.

5. A can opener as defined in claim 1; and further comprising means for preventing unintentional movement of said members from said inoperative position to said operative position, by temporarily arresting said members with one another so that said movement from said inoperative position to said operative position can be performed only by a user.

6. A can opener as defined in claim 5, wherein said second member has a through openings, and said first member has a loop-shaped projection extending through said through opening so as to form said connecting means, said through opening of said second member forming together with the other lateral side of the same a web around which said loop-shaped projection extends, said web having a predetermined dimension in the transverse direction of said second member, said loop-shaped projection of said first member having an inner opening with two transverse dimensions which are selected so that when said member are in said inoperative position said web of said first member is clamped in said inner opening so as to form said preventing means.

7. A can opener as defined in claim 6, wherein one of said transverse dimensions of said inner opening of said loop-shaped projection extends transverse to the plane of said first member and is greater than the dimension of said web of said second member, the other of said transverse dimensions of said inner opening of said loop-shaped projection of said first member is at most equal to the dimension of said web so that in said inoperative position of said members the dimension of said web and the other dimension of said inner opening coincide with one another and said web is clamped by an inner wall of said inner opening.

* * * * *